US009447791B2

(12) United States Patent
Aschermann et al.

(10) Patent No.: US 9,447,791 B2
(45) Date of Patent: Sep. 20, 2016

(54) FAN COMPRISING FAN BLADES

(75) Inventors: Uwe Aschermann, Karlsruhe (DE); Ulrich Vollert, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 747 days.

(21) Appl. No.: 13/879,121

(22) PCT Filed: Oct. 12, 2011

(86) PCT No.: PCT/EP2011/067835

§ 371 (c)(1),
(2), (4) Date: Jun. 19, 2013

(87) PCT Pub. No.: WO2012/049220

PCT Pub. Date: Apr. 19, 2012

(65) Prior Publication Data

US 2013/0287581 A1 Oct. 31, 2013

(30) Foreign Application Priority Data

Oct. 12, 2010 (DE) ..... 10 2010 042 325

(51) Int. Cl.
*F04D 29/38* (2006.01)
*F04D 29/32* (2006.01)

(52) U.S. Cl.
CPC ..... *F04D 29/384* (2013.01); *F04D 29/329* (2013.01)

(58) Field of Classification Search
CPC .... F04D 19/002; F04D 25/08; F04D 25/082; F04D 29/26; F04D 29/325; F04D 29/34; F04D 29/38; F04D 29/384
USPC ..... 416/234, 239, 169 R, 169 A
See application file for complete search history.

(56) References Cited

U.S. PATENT DOCUMENTS

| | | | | |
|---|---|---|---|---|
| 3,844,680 | A | 10/1974 | Säterdal | |
| 4,671,739 | A * | 6/1987 | Read | F04D 29/325 416/134 R |
| 6,375,427 | B1 * | 4/2002 | Williams | F04D 29/384 416/169 A |
| 6,382,915 | B1 * | 5/2002 | Aschermann | F04D 29/329 416/169 A |
| 6,659,724 | B2 * | 12/2003 | Takeuchi | F04D 29/325 123/41.49 |
| 6,726,454 | B2 | 4/2004 | Blass et al. | |
| 2005/0260077 | A1 | 11/2005 | Sato | |
| 2010/0092297 | A1 | 4/2010 | Surls | |
| 2012/0321467 | A1 * | 12/2012 | He | F04D 29/384 416/144 |

FOREIGN PATENT DOCUMENTS

| | | | |
|---|---|---|---|
| DE | 199 29 978 | A1 | 1/2001 |
| EP | 0 463 385 | A2 | 1/1992 |
| EP | 1 219 837 | B1 | 8/2006 |
| JP | 2003-531341 | A | 10/2003 |
| RU | 2 124 654 | C1 | 1/1999 |
| SU | 474164 | A3 | 6/1975 |

OTHER PUBLICATIONS

International Search Report, PCT/EP2011/067835, Mar. 7, 2012, 2 pgs.
German Search Report, DE 10 2010 042 325.4, Aug. 24, 2011, 5 pgs.

* cited by examiner

*Primary Examiner* — Richard Edgar
(74) *Attorney, Agent, or Firm* — Paul D. Strain, Esq.; Strain & Strain PLLC

(57) ABSTRACT

A fan, with fan blades, especially used for the cooling of a motor vehicle, with the fan blades being fixed to a fan hub. In spite of being made of only a small amount of material, the fan is highly resistant to the flow conditions in the motor vehicle, each fan blade being bent rearwards at an angle in the direction of a blade root, an angled region of the fan blade being at least partially bent downwards towards the fan hub.

11 Claims, 8 Drawing Sheets

FAN COMPRISING FAN BLADES

CROSS-REFERENCE TO RELATED PATENT APPLICATIONS

Figure 1:
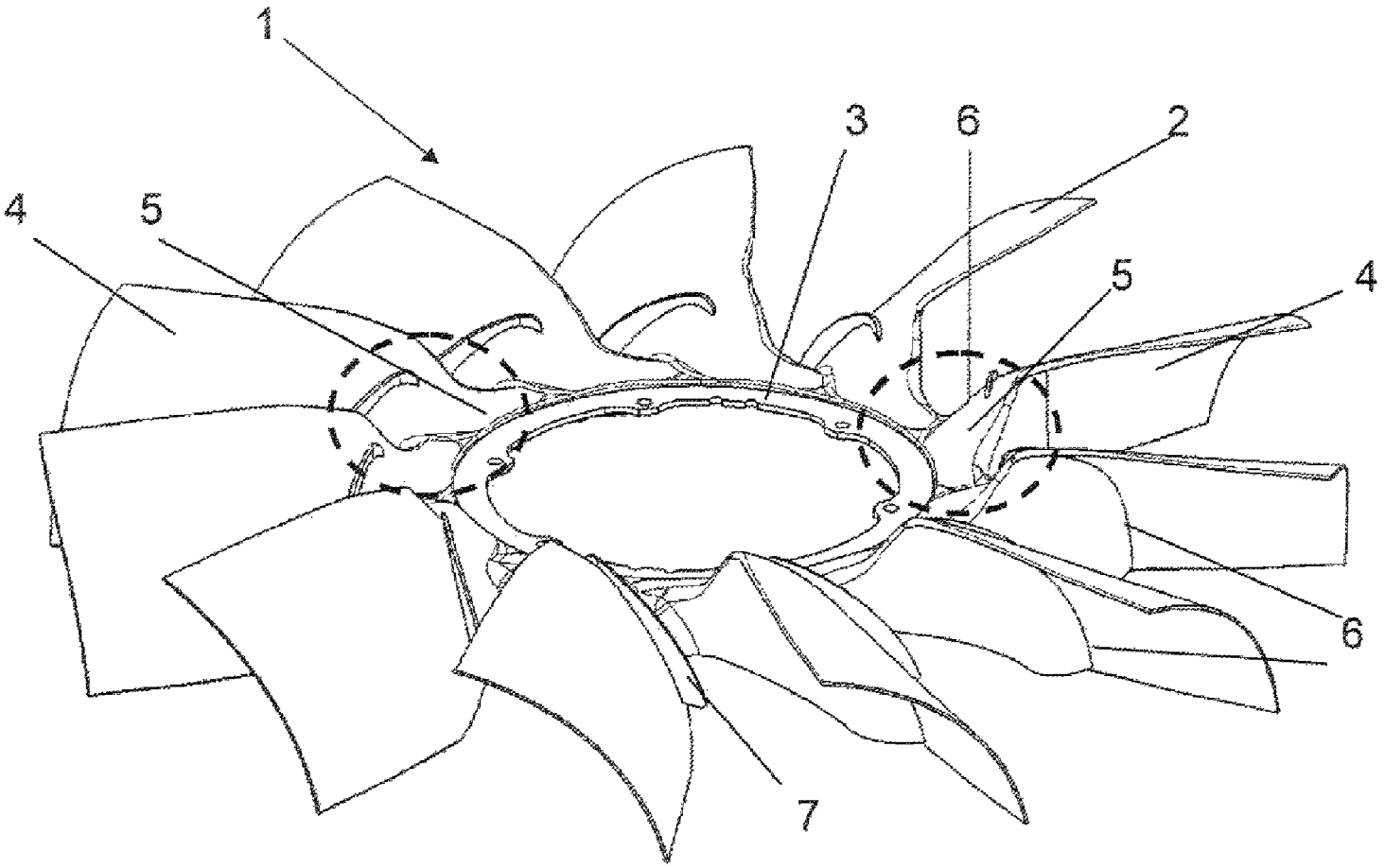

This application is a National Stage of International Application No. PCT/EP2011/067835, filed Oct. 12, 2011, which is based upon and claims the benefit of priority from prior German Patent Application No. 10 2010 042 325.4, filed Oct. 12, 2010, the entire contents of all of which are incorporated herein by reference in their entirety.

The invention concerns a fan comprising fan blades, in particular for radiators of motor vehicles, wherein the fan blades are attached to a fan hub.

According to DE 199 29 978 A1, a fan with fan blades is known which comprises a hub ramp on the pressure side of the fan blades, whereby the flow is stabilized on the pressure side of the fan blades. On the suction side region of the fan blades, air conduction elements are arranged which form a flow channel and guide the air in a targeted manner from the hub to the suction side of the fan blade, i.e. in the region of the cylindrical fan hub or in the region of the hub ramp.

EP 1 219 837 B1 discloses a further fan with fan blades in which the air conduction elements are formed as fin-like stabilizers. The external faces of the stabilizers and the faces of further radial blade elements arranged on the stabilizers are integrated in each other so as to form a common transition-free face. Here the hub ramp which is arranged on the pressure side of the fan blade also extends from the blade root region in which the stabilizer begins, together with the radial blade element.

Such an arrangement has the disadvantage that, in the region of the attachment of the fan blades to the fan hub, mass accumulations occur which entail the risk that production-induced air inclusions or cavities can be enclosed in these mass accumulations. In addition a long production time is required since very long cooling times are necessary. At the same time a high material usage is necessary.

The invention is therefore based on the object of specifying a fan comprising fan blades which guarantees a reduction in mass accumulations in the region of the attachments of the fan blades, wherein the production costs of the fan are reduced and the production time shortened.

According to the invention this object is achieved in that each fan blade is angled rearward in the direction of a blade root, wherein an angled region of the fan blade is bent down at least partly towards the fan hub.

This has the advantage that the mass accumulations are reduced, whereby the risk of production-induced air inclusions and cavities is reduced and a shorter production time is guaranteed. Due to the downwardly bent front edge of the fan blade, the strength of the fan is increased while the material usage is significantly lower.

Advantageously a curvature and/or a radius of the fan blade in a first region of the fan blade extending outward from the angle is different to a curvature and/or a radius of the second region extending from the angle in the direction of the fan hub, wherein the second region of the fan blade is bent down towards the fan hub. Such an attachment of the fan blade to the fan hub achieves a highly homogeneous and stress-optimized transition.

In one embodiment the front edge of the second region of the fan blade which is bent down towards the fan hub is formed in a sickle-shaped manner, curving forwards in the direction of rotation. This design improves the flow conditions between two successive fan blades. The sickle shaping of the fan blade in the region of the fan hub also serves to improve the acoustic properties of the fan.

In a variant, a hub ramp between two fan blades is formed conically. This hub ramp stabilizes the hub region, allowing a cleaner and low-loss air flow past the blade root in the region of the fan hub.

In one embodiment the hub ramp, starting from the blade root of a fan blade arranged on the fan hub, is guided directly onto the rear edge of the following fan blade. In this design the hub ramp forms an integral part of the fan blade, which is particularly advantageous in relation to flow dynamics. This guarantees the strength of the fan with low material usage.

In a refinement, a stabilizer is arranged on a side of the fan blade facing away from the hub ramp and is formed in particular on the second region of the fan blade in the segment of the fan blade which is bent down towards the fan hub. The stabilizer serves as a flow conduction element and suppresses eddy structures in the region of the fan hub.

In another embodiment the stabilizer runs on a smaller radius than the hub ramp on the back of the fan blade. Here the stabilizer is arranged as an injection molding on the fan blade. The stabilizers in the blade root region of the fan blades cause a separation of the hub and blade flows on the suction side of the fan blades, and prevent flow detachment and harmful eddy formation.

Advantageously the center of gravity of the fan blade, preferably of the first region of the fan blade, is displaced so far forward towards the suction side that a centrifugal force acting on the fan blade and an aerodynamic force generated by the pressure increase approximately compensate for each other. This has the advantage that the reaction force of the fan blade resulting from the centrifugal forces lies in front of the fan hub in the flow direction.

In a refinement, at least one rib is arranged radially on the pressure side of the fan at the point of attachment of the blade root to the fan hub. This guarantees the force flow from the fan hub into the fan blade.

In a variant, the rib has a curved outer edge, wherein the rib extends from the fan hub preferably up to the hub ramp. This flow-optimized curvature of the back edge of the rib reduces the material usage. In addition the at least one rib is arranged on the fan hub next to the actual attachment of the fan blade, which relieves the load on this attachment which is exposed to the greatest loading from the rising pressure.

Numerous embodiments are based on the invention. One of these is explained in more detail below with reference to the figures in the drawing.

Figure 2:
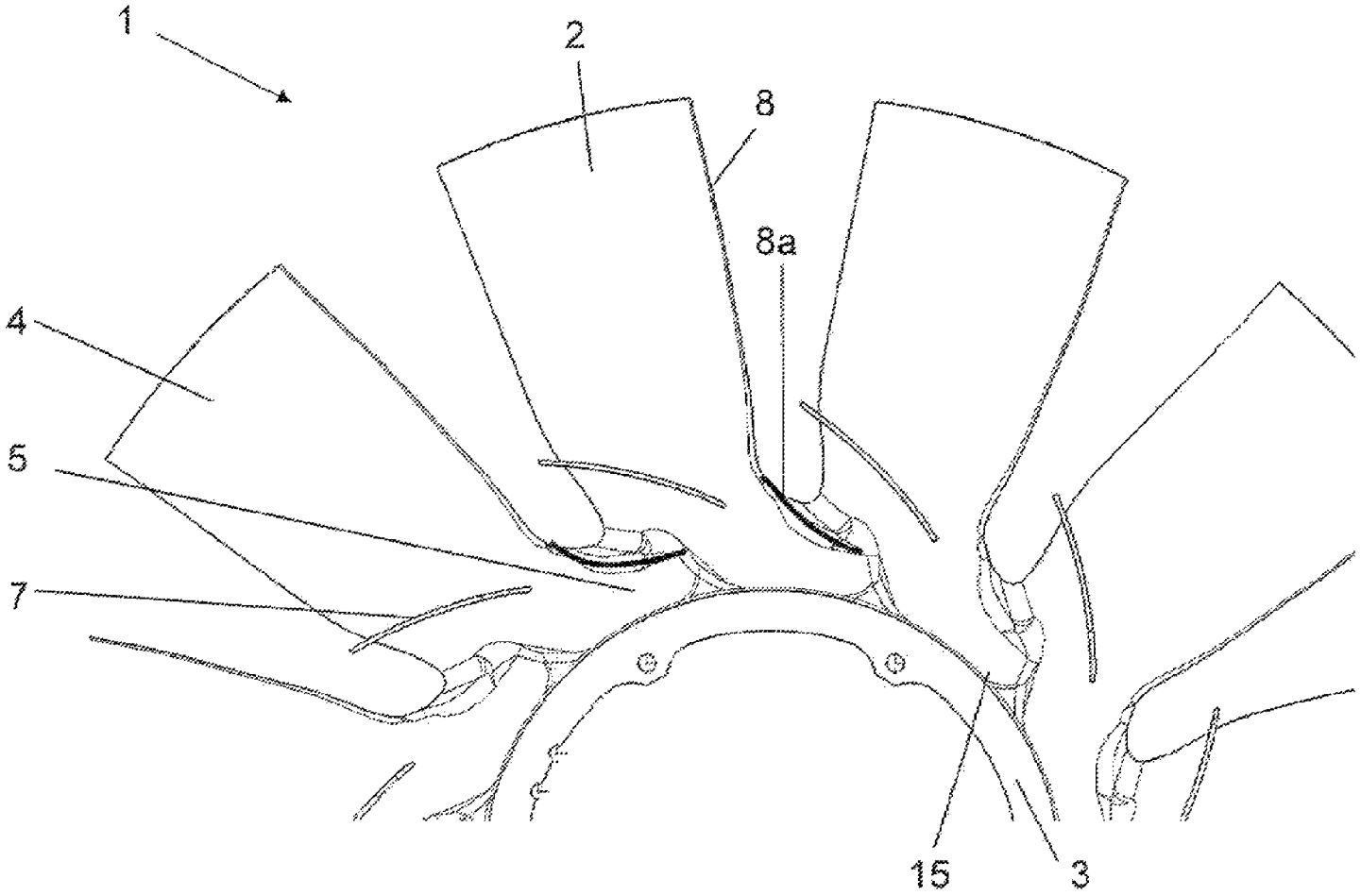

FIG. 1: shows a perspective view of an embodiment of the fan according to the invention FIG. 2: shows an extract of a front side of the fan according to FIG. 1

Figure 3:
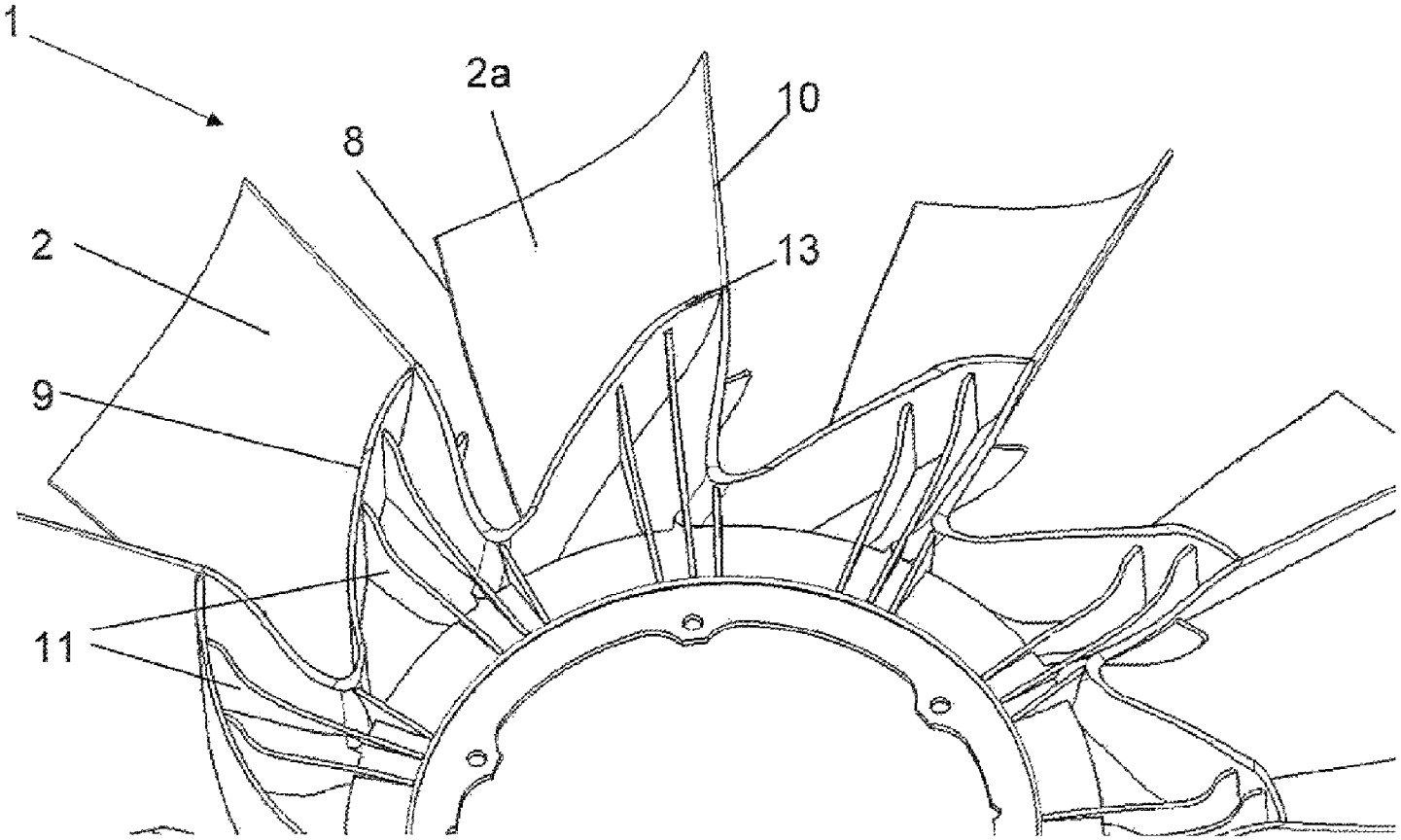

FIG. 3: shows an extract of a back of the fan according to FIG. 1

Figure 4:
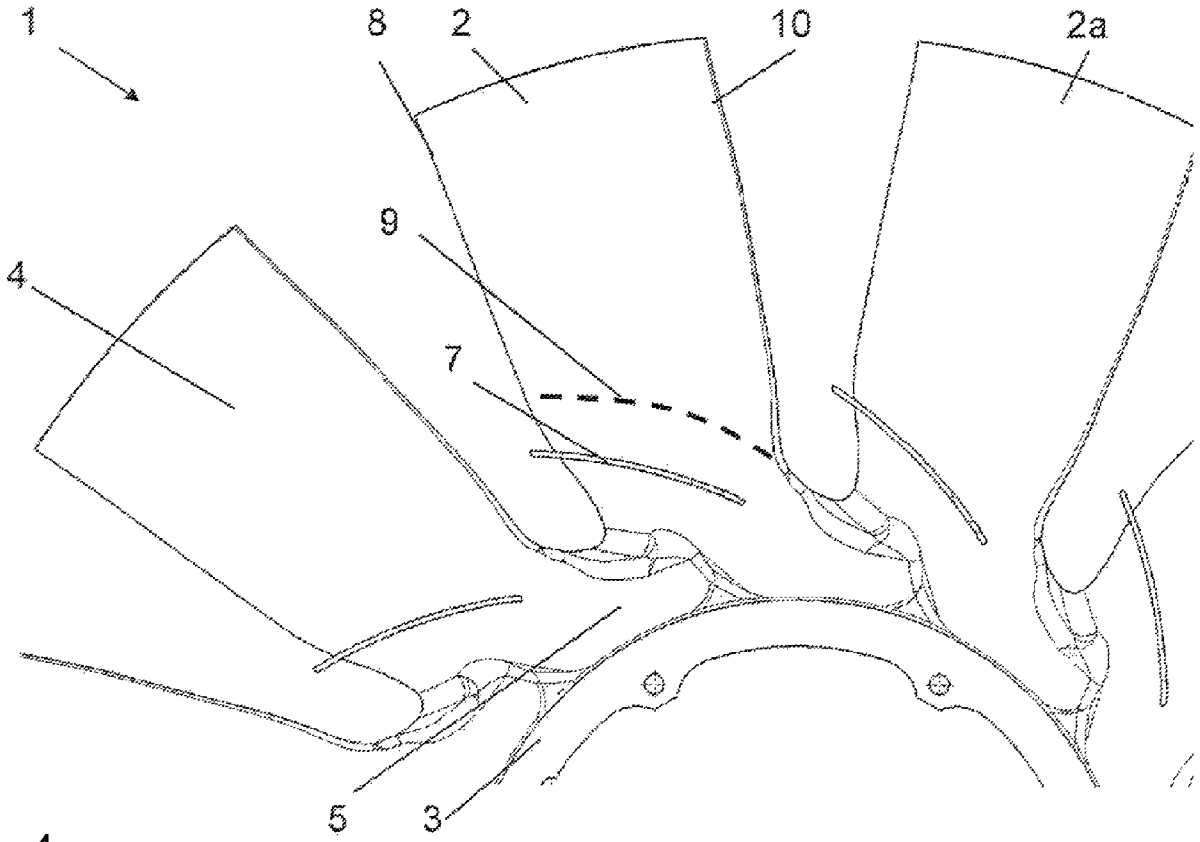

FIG. 4: shows the stabilizer and a ramp on a fan blade

Figure 5:
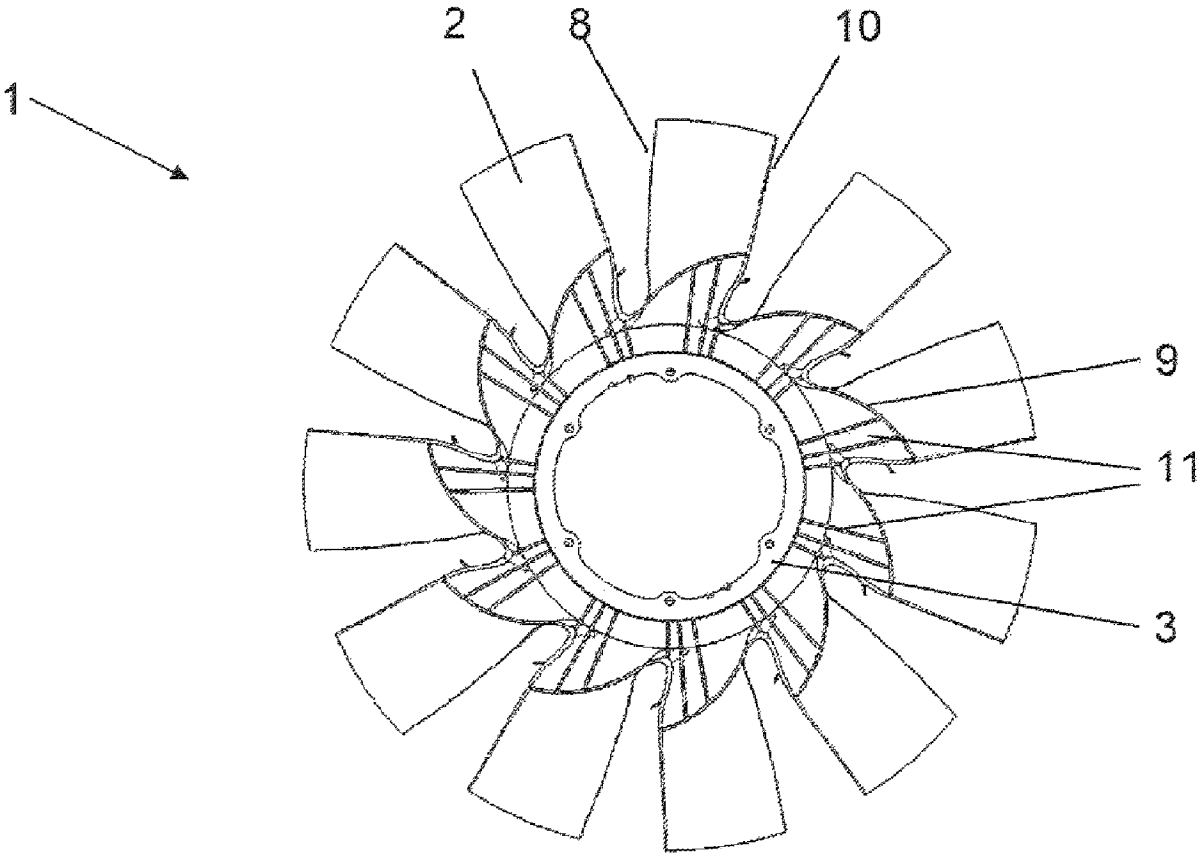

FIG. 5: shows radially arranged ribs on the back of the fan

Figure 6:
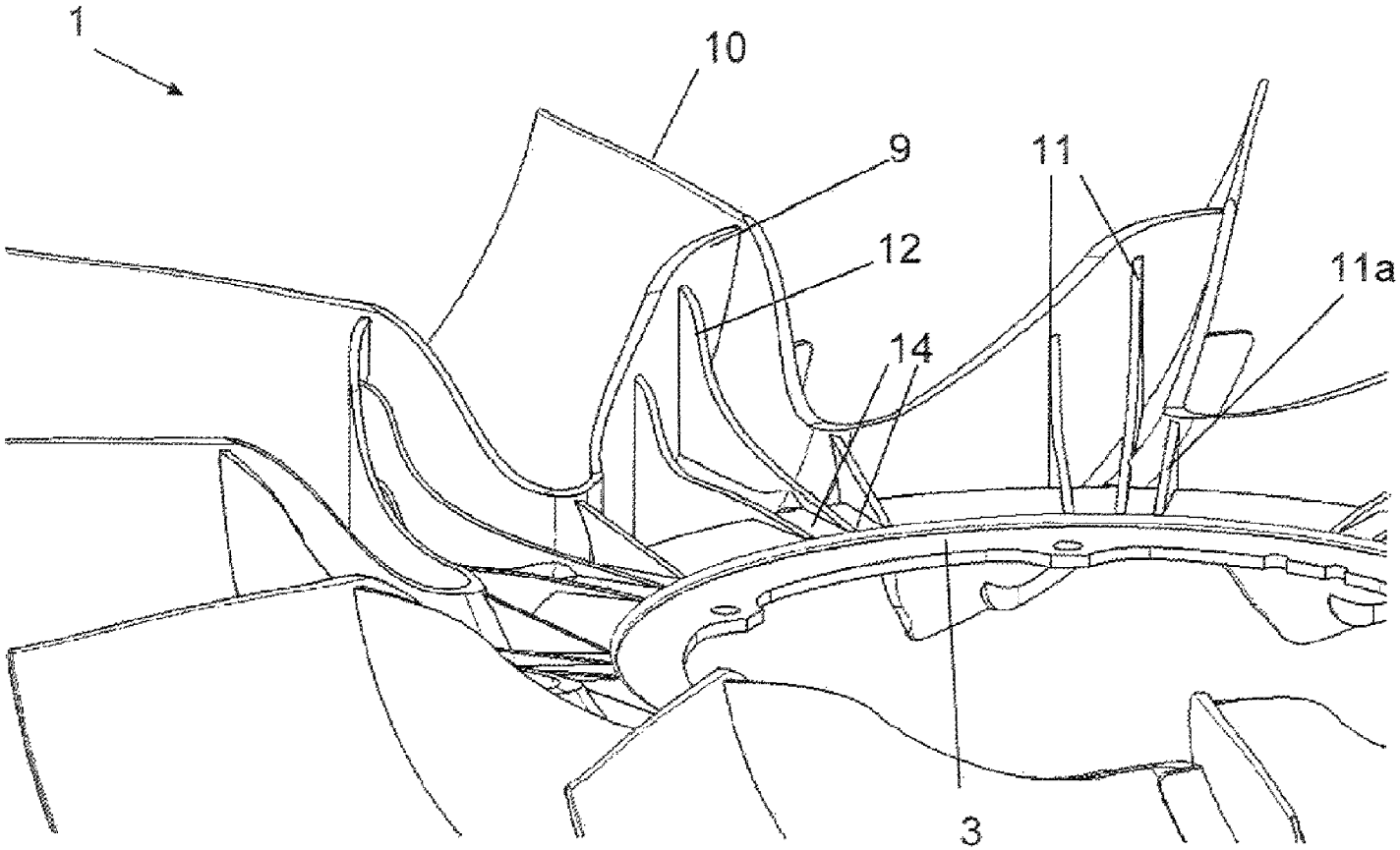

FIG. 6: shows an enlarged depiction of the radially arranged ribs according to FIG. 5

Figure 7:
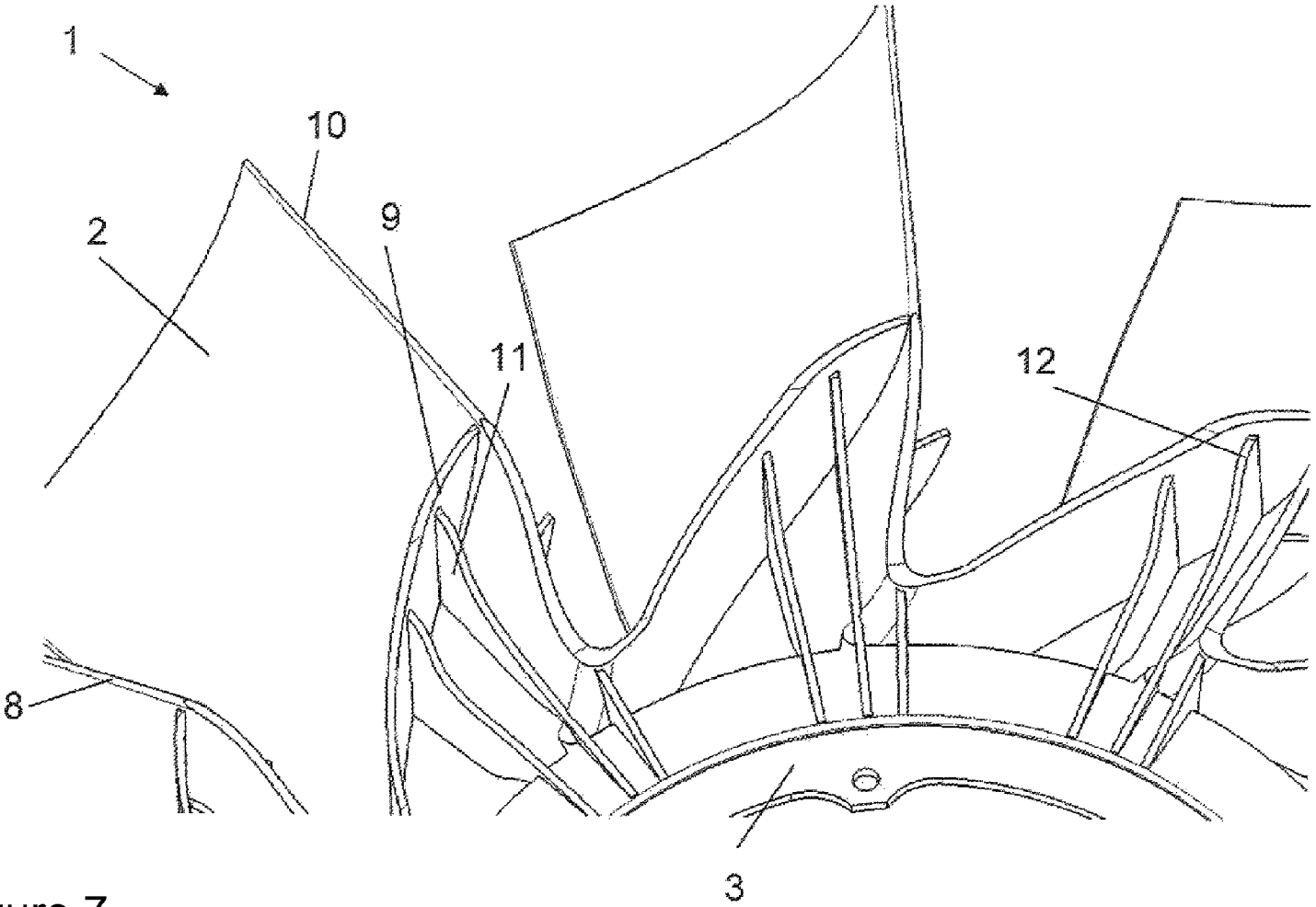

FIG. 7: shows the attachment of the fan blade to the fan hub

Figure 8:
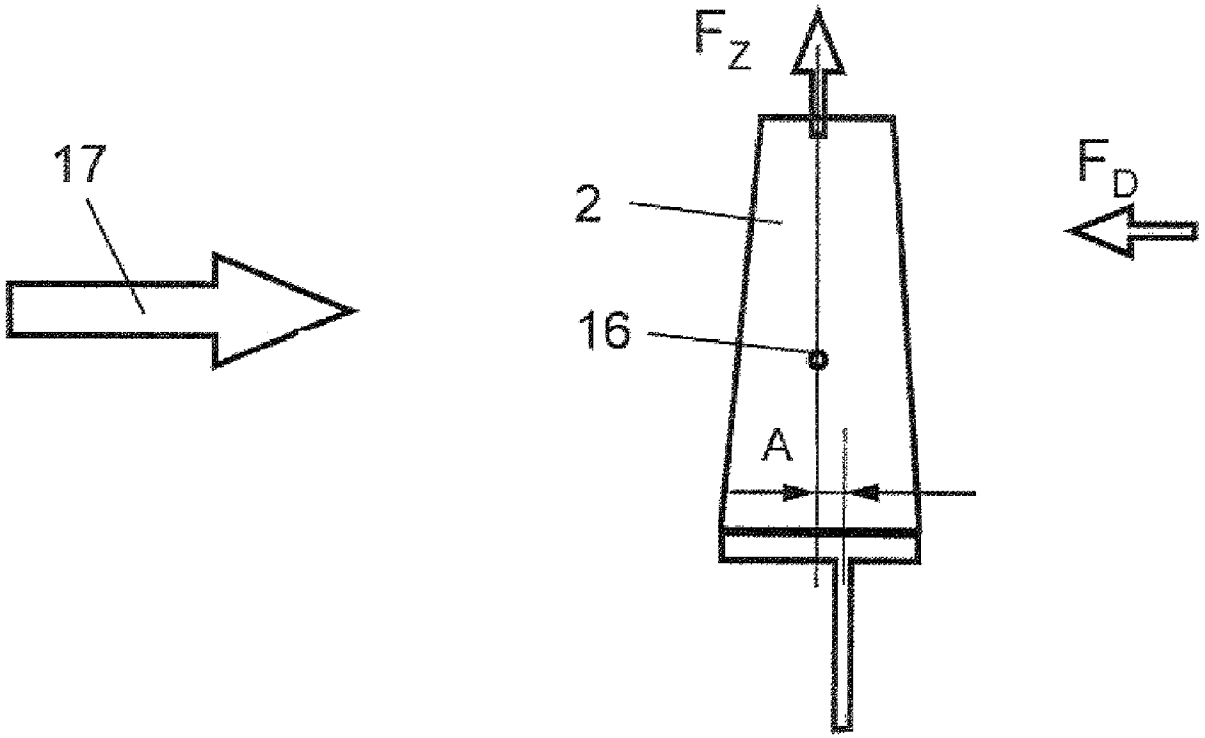

FIG. 8: is a principal depiction of the force ratios which act on the fan blade.

The same features carry the same reference numerals.

A fan comprising fan blades formed as axial blades is used in a truck, where it is driven by a vehicle engine. The fan is connected here to the engine face either directly on a crankshaft or via a belt or gear drive. The fan rotation time is controlled by a coupling arranged inside the fan hub. Because of this coupling to the vehicle engine, high mechanical loads act on the fan. Firstly in the form of vibrations of the vehicle engine or due to the flexion of the crankshaft. Secondly due to the rotation speed. Thus for example an over-revving of the vehicle engine as a result of a shift error is not regulated out by the coupling sufficiently quickly, so a high rotation speed load acts on the fan.

Such a fan 1 is shown in FIG. 1 and comprises several fan blades 2 which are arranged about a fan hub 3 and attached thereto via a blade root 15. Each fan blade 2 is divided into two regions 4, 5. The fan blade 2 has an angle 6 between these regions 4, 5. The second inner region 5 leading to the fan hub is bent here rearward away from the first outwardly protruding region 4 and lies on the fan hub 3. The first region 4 of the fan blade 2 therefore has a different circle arc profile from the second region 5 of the fan blade 2 which is bent down towards the fan hub 3. At the angle 6, a smaller radius follows from the first larger radius of the first region 4 of the fan blade 2, so that the second region 5 of the fan blade 2 forms a different circle arc from the first region 4 of the fan blade 2. Thus the curvatures of the first region 4 and the second region 5 of the fan blade 2 change. This kink 6 achieves a blade-like form of the fan blade 2. Bending the second region 5 of the fan blade 2 down towards the fan hub 3 achieves a very homogeneous and stress-optimized transition between the fan blade 2 and the fan hub 3, and at the same time ensures good ventilation of the coupling which is not shown in detail and is normally arranged inside the fan hub 3.

As evident from FIG. 2, the front edge 8 of the downwardly bent second region 5 of the fan blade 2 is curved forward in a sickle shape in the direction of rotation of the fan 1. The sickle-shaped region of the front edge 8 of the fan blade 2 in the region of the fan hub 3 is denoted by reference numeral 8*a*. This sickle shape contributes to improving the acoustics of the fan 1. The curvature of the second region 5 of the fan blade 2 is extended out of the region of the fan hub 3.

FIG. 3 shows an extract of the back (pressure side) of the fan 1, wherein on each fan blade 2 is arranged a hub ramp 9. This hub ramp 9 is formed conically in the region between the fan blade 2 and the following fan blade 2*a*. The front edge 13 of the ramp is rounded and bent inward towards the fan hub 3. The hub ramp 9, starting from the fan hub 3, is guided directly from the preceding fan blade 2 onto the rear edge 10 of the following fan blade 2*a*. Here the hub ramp 9 and fan blade 2 form one assembly and are fused together integrally as the hub ramp 9 extends starting from the connecting point of the second region 5 of the fan blade 2. The hub ramp 9 ends here at the rear edge 10 of the following fan blade 2*a*, approximately at half the height of the fan blade 2*a*. This design guarantees the strength of the fan 1 while the material usage is low. The hub ramp 9 is stabilized against the fan hub 3 by several ribs 11.

FIG. 4 shows an extract of the front (back-up side) of the fan 1. On the front of the fan blade 2 is arranged a stabilizer 7. The hub ramp 9 which is on the back of the fan blade 2 is shown in dotted lines for this reason. The stabilizer 7 stands approximately vertical to the fan blade 2 and protrudes from this, stabilizing the flow. The stabilizer 7 serves as a flow conduction element to suppress the propagation of eddy structures in the region of the fan hub 3. The stabilizer 7 begins on the fan blade 2 in the downwardly bent region 5 (second region 5 of fan blade 2) and ends at the front edge 8 of the fan blade 2. In comparison with the fan hub 3, the stabilizer 7 has a smaller radius than the hub ramp 9.

FIG. 5 shows a top view of the back of the fan 1, on which are arranged the radially extending ribs 11 which serve to stiffen the fan 1. In this embodiment, at least three ribs 11 are arranged on each fan blade 2, wherein at least two of these ribs 11 support the hub ramp 9. These ribs 11 contribute to relieving the load on the respective fan blade 2 when stress peaks occur. The force flow from the fan hub 3 into the fan blades 2 is guaranteed by the ribs 11.

As evident from FIGS. 6 and 7, the fan blade 2 at the point where it makes contact with the fan hub 3 is reinforced by a rib 11*a*. The ribs 11 are arranged to the right and left of the attachment 14 of the fan blade 2 to the fan hub 3. This relieves the load on this point, which is the point with the highest loading. The depth of the ribs 11 at the attachment 14 to the fan hub 3 and the hub ramp 9 is minimal for reasons of material saving, but deep enough to prevent excessive stresses in the hub ramp 9 due to the centrifugal force acting on the fan blade 2. The rib 11 ends around 2 cm from the rear edge of the hub ramp 9. The ribs 11 have a curved outer edge 12 and widen out in their surface starting from the fan hub 3 in the direction of the hub ramp 9. This curved rib form improves the flow conditions at this point.

FIG. 8 shows a schematic depiction of the forces which occur at the fan 1 when the fan is rotating, viewed from the side onto the fan blade 2. The fan blade 2 is not arranged centrally in relation to the hub 3 but the center of gravity 16 of the fan blade 2 is displaced forward towards the front (suction side) of the fan 1. The air delivery direction 17 meets the fan blade 2 from the left. When the fan 1 rotates, a centrifugal force $F_Z$ of the fan blade 2 is generated which acts on the front edge of the fan blade 2. This means that the reaction force $F_R$ of the fan blade 2, resulting from the centrifugal forces $F_Z$ and determined from $$F_R = \int \omega^2 \rho dV dr$$

wherein

ω=rotation speed of fan

ρ=density

V=displaced air volume r=radius of fan, lies in front of the fan hub 3 viewed in the flow direction.

This centrifugal force $F_Z$ is opposed by an aerodynamic force $F_D$. This aerodynamic force $F_D$ occurs on the back (pressure side) of the fan blade 2 due to a pressure rise. The aerodynamic force $F_D$ acts on the back edge of the fan blade 2 and attempts to move the fan blade 2 in the direction of the air delivery direction 17. The fan blade 2 thus builds up the pressure.

When the rotation speed of the fan 1 is constant, these aerodynamic forces are dependent on the working point so that for the design of the fan 1 an assumption must be made relating to the working point. No moment is initiated in the fan hub 3. The aerodynamic forces and the centrifugal forces thus rise quadratically with the rotation speed.

Because of the lateral displacement of the center of gravity of the fan blade 2 by the distance a from the fan hub 3 in the direction of the air delivery direction 17, the centrifugal force $F_Z$ does not act on the fan hub 3 but attempts to tip the fan blade 2 rearward. This is compensated by the acting aerodynamic forces $F_D$ because of the particular spacing of the fan blade 2 from the fan hub.

The fan 1 described is made from a plastic material. For production reasons the fan 1 is manufactured with a simple two-position tool without using sliders, wherein the use of plastic is minimized.

The invention claimed is:

1. A fan comprising fan blades, wherein each fan blade comprises a leading edge, a trailing edge, and a blade root, wherein each fan blade is connected to a fan hub at the blade root and is arranged radially outward, wherein each fan blade is divided into a first outwardly protruding region and a second inner region such that an angle is formed where the first region and the second region join, wherein the second inner region of each fan blade is angled in the direction of the trailing edge and away from the first outwardly protruding region in the direction of the blade root, wherein the second inner region of the fan blade is further bent downward with respect to the first outwardly protruding region at least partly towards the fan hub.

2. The fan as claimed in claim 1, wherein a curvature or a radius of the surface of the fan blade in the first outwardly protruding region is different than a curvature or a radius of the surface of the second inner region.

3. The fan as claimed in claim 1, wherein the leading edge of the second inner region of the fan blade is formed in a sickle-shaped manner which is concave towards the direction of rotation.

4. The fan as claimed in claim 1, wherein a hub ramp is formed conically in the region between the leading edge of one fan blade and the trailing edge of the next fan blade.

5. The fan as claimed in claim 4, wherein the hub ramp, starting from the blade root of the fan blade arranged on the fan hub, is guided directly onto the rear edge of the following fan blade.

6. The fan as claimed in claim 5, wherein a stabilizer is arranged on a side of the fan blade facing away from the hub ramp and is formed on the second inner region of the fan blade in a segment bent down towards the fan hub.

7. The fan as claimed in claim 6, wherein the stabilizer comprises a radial or arcuate form which has a shorter length than a radial or arcuate arc of intersection between the hub ramp and a back of the fan blade.

8. The fan as claimed in claim 1, wherein a center of gravity of the fan blade is displaced so far forward towards a suction side that a centrifugal force acting on the fan blade and an aerodynamic force generated by a pressure increase on the fan blade approximately compensate for each other.

9. The fan as claimed in claim 5, wherein at least one rib is arranged radially on a pressure side of the fan approximately at the attachment of the blade root to the fan hub.

10. The fan as claimed in claim 9, wherein the rib has a curved outer edge and extends from the fan hub.

11. The fan as claimed in claim 10, wherein the rib extends up to the hub ramp.

* * * * *